US006949316B2

(12) United States Patent
Aoki

(10) Patent No.: US 6,949,316 B2
(45) Date of Patent: Sep. 27, 2005

(54) CONNECTOR

(75) Inventor: Masayoshi Aoki, Tokyo (JP)

(73) Assignee: Taiko Denki Co., Ltd., Tokyo (JP)

( * ) Notice: Subject to any disclaimer, the term of this patent is extended or adjusted under 35 U.S.C. 154(b) by 29 days.

(21) Appl. No.: 10/846,652

(22) Filed: May 17, 2004

(65) Prior Publication Data

US 2004/0248447 A1 Dec. 9, 2004

(30) Foreign Application Priority Data

Jun. 6, 2003 (JP) ..... 2003-163054

(51) Int. Cl.[7] ..... H01R 13/15
(52) U.S. Cl. ..... 429/260; 439/607; 439/495
(58) Field of Search ..... 439/260, 492, 439/493, 494, 495, 496, 497, 607

(56) References Cited

U.S. PATENT DOCUMENTS 6,231,378 B1 * 5/2001 Wu et al. ..... 439/495
6,325,681 B1 * 12/2001 Doi ..... 439/495
6,386,905 B1 * 5/2002 Ito ..... 439/495
6,761,573 B1 * 7/2004 Chiu ..... 439/260

FOREIGN PATENT DOCUMENTS

JP Y2 2580074 6/1998

* cited by examiner

*Primary Examiner*—Briggitte R. Hammond
(74) *Attorney, Agent, or Firm*—Oliff & Berridge, PLC

(57) ABSTRACT

The present invention provides a connector able to be made thin so as to satisfy the needs of making an electronic device further light in weight, thin, short and compact. Therefore, the connector has a connector main body having a housing for storing a contactor and having an opening portion, and an actuator rotatably supported with respect to the connector main body. A flexible cable inserted into the opening portion and the contactor come in press contact with each other by the actuator and are electrically connected to each other in the rotation of the actuator. A metallic cover for covering a portion of the housing and having a receiving portion is arranged in the connector main body. When the actuator makes the flexible cable inserted into the opening portion come in press contact with the contactor, the receiving portion receives reaction force of the press contact. Thus, the thin type connector can be provided.

4 Claims, 4 Drawing Sheets

CONNECTOR

BACKGROUND OF THE INVENTION

The present invention relates to a connector of a ZIF (Zero Insertion Force) type for a flexible cable as in FPC (Flexible Printed Circuit) and FFC (Flexible Flat Cable).

DESCRIPTION OF THE RELATED ART

Connectors of various forms are used in connecting the flexible cable to a circuit substrate. The connector of the zero insertion force type (ZIF type) as one of these connectors is very widely utilized.

For example, as shown in FIG. 7, there is a conventional connector having a housing 100 and an actuator 300 (see patent literature 1). The housing 100 stores a contactor 101 thereto and has an opening portion 102 and is constructed by an insulating material. The actuator 300 is rotatably supported by a rotating support portion 101*b* formed integrally with the contactor 101 and is constructed by an insulating material.

In such a conventional connector, in a state in which the actuator 300 is located in the position shown by the two-dotted chain line and the opening portion 102 is greatly opened, a flexible cable 500 is inserted into the opening portion 102 from the direction of the arrow X. Subsequently, the actuator 300 is rotated until a lock position for making the actuator 300 fall down. Thus, the cable 500 comes in press contact with a contact portion 101*a* of the above contactor 101 by a pressing portion 301 of the actuator 300, and the cable 500 and the contactor 101 are electrically connected to each other.

In this example, the rotating support portion 101*b* and the contact portion 101*a* are formed so as to fork into two branches from one contactor 101. The flexible cable 500 and the pressing portion 301 of the actuator 300 are structurally nipped and supported between the rotating support portion 101*b* and the contact portion 101*a*.

[Patent Literature 1]

JP-UM-A-6-77186 (Japanese Utility Model Laid-Open No. 6-77186)

The needs of high performance, lightness, thinness, shortness and smallness of various kinds of electronic devices are unceasingly required. The requests with respect to multiple functions, high density, compactness, lightness, thinness and shortness are more and more strengthened. In accordance with these requests, the compactness, thinness and shortness of the connector and its multipolar change are simultaneously required.

However, in the conventional connector as mentioned above, it was difficult to make the connector thin in accordance with the needs of markets. This is because the above conventional connector requires at least six members of different roles constructed by a bottom plate portion 103, the contact portion 101*a*, the flexible cable 500, the pressing portion 301, the rotating support portion 101*b* and an upper plate portion 104 in the thickness direction of the connector so that the connector has a thickness obtained by summing the respective thicknesses of at least these members as a whole.

The respective heights of the above members are tried to be lowered to make the above conventional connector thin (in this case, the thickness of the flexible cable 500 is determined by standards, and there is no degree of freedom in design in making the connector thin). However, when the respective members are made thin, their rigidities are naturally reduced. Therefore, there was naturally a limit in making the respective members thin.

In particular, when the actuator 300 is rotated in the connector of such a type, the pressing portion 301 of the actuator 300 is forcibly intended to enter between the flexible cable 500 and the rotating support portion 101*b*. Therefore, a large stress is applied to the rotating support portion 101*b* for receiving reaction force from the contact portion 101*a* caused at this entering time.

However, the rotating support portion 101*b* of the above conventional connector is formed integrally with the contact portion 101*a* constructed by an electrically conductive metal such as phosphor bronze, etc. having no high rigidity. Therefore, it was necessary to secure a considerable thickness so as to have a strength resisting the above stress caused by rotating the actuator 300.

Further, the above stress caused in the above conventional connector is also transmitted to the housing 100 constructed by an insulating material such as synthetic resin, etc. having a low strength. Therefore, the bottom plate portion 103 and the upper plate portion 104 of the housing 100 covering the upper and lower portions of the rotating support portion 101*b* and the contact portion 101*a* had to have considerable thicknesses.

Accordingly, for example, when the flexible cable of 0.3 mm in thickness is used, a clearance required to set the flexible cable to the ZIF must be also prepared with respect to the entire thickness of the above conventional connector. Therefore, the entire thickness becomes about 2 mm, which is difficult to satisfy the needs of markets.

SUMMARY OF THE INVENTION

In consideration of such points, an object of the present invention is to provide a connector able to be made thin so as to satisfy the needs of making an electronic device further light in weight, thin, short and compact.

To achieve the above object, the present invention resides in a connector comprising a connector main body having a housing for storing plural contactors and an opening portion and constructed by an insulating material, and an actuator rotatably supported with respect to the connector main body and constructed by an insulating material, wherein a flexible cable inserted into the opening portion and the contactors come in press contact with each other by the actuator and are electrically connected to each other in the rotation of the actuator; the connector main body has a metallic cover for covering a portion of the housing and having a holding portion for holding the housing, a fixing portion fixed to a circuit substrate and one or more engagement receiving portions; the actuator has one or more engaging portions engaged with the engagement receiving portions in the rotation; and the metallic cover has a receiving portion for receiving reaction force of the press contact when the actuator makes the flexible cable come in press contact with the contactors. Since the rigid metallic cover has the function of the receiving portion, a thin type connector can be provided.

Further, the connector can be made thinner if the engagement receiving portion is an engagement through hole extending through the metallic cover.

Further, if the metallic cover has a lock portion and the actuator has a locked portion corresponding to the lock portion, a click feeling can be provided at the lock time.

DESCRIPTION OF THE PREFERRED EMBODIMENTS

The preferred embodiment mode examples of a connector for a flexible cable in the present invention will next be explained with reference to FIGS. 1 to 6.

Figure 1:
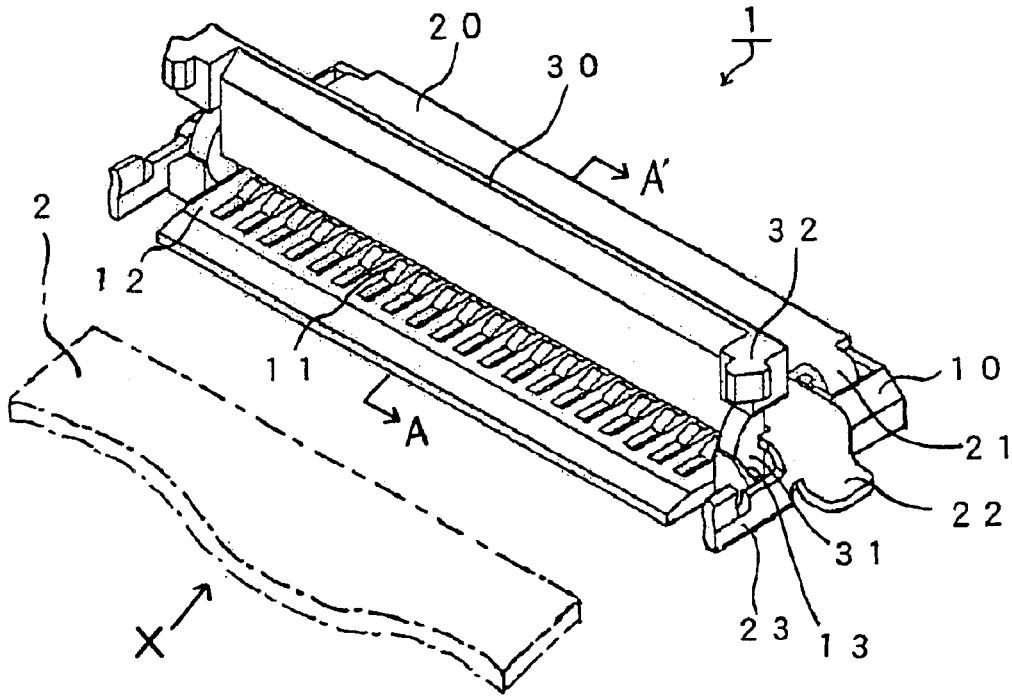
FIG. 1 is a perspective view of the external appearance of a connector in one embodiment mode of the present invention and shows an unlock state in which an actuator stands erect.
Figure 2:
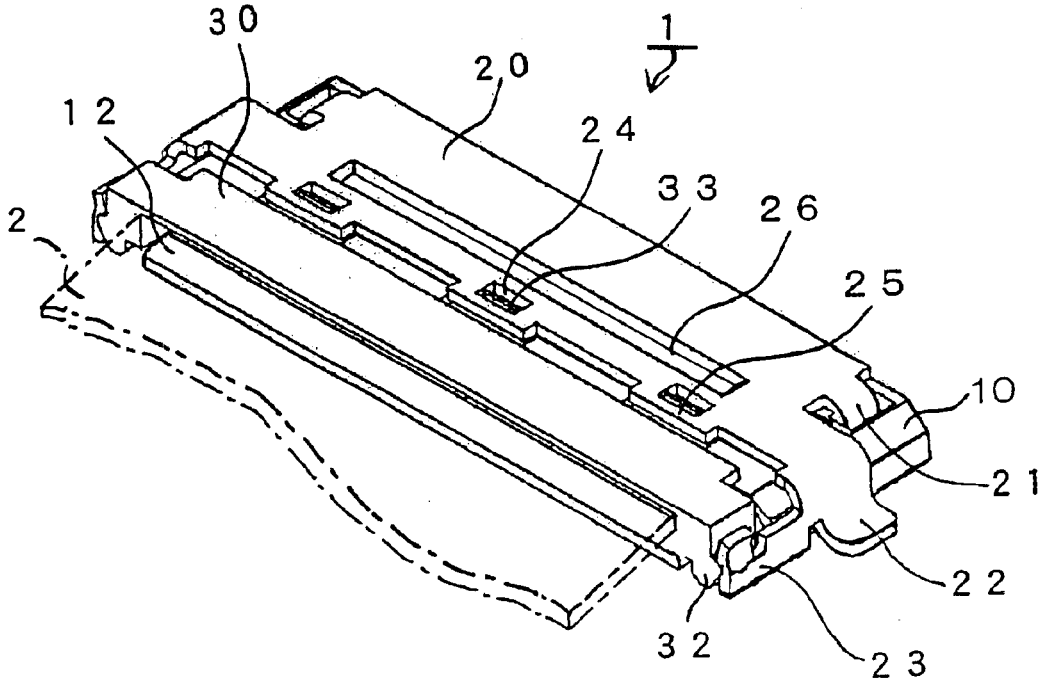
FIG. 2 is a perspective view of the external appearance showing a lock state in which the actuator of the connector of FIG. 1 falls down.

Each of FIGS. 1 and 2 is a perspective view of the external appearance of a connector 1 in the present invention. FIG. 1 shows an unlock state in which an actuator 30 rises. FIG. 2 shows a lock state in which the actuator 30 falls down.

The connector 1 has a connector main body having a housing 10 and a metallic cover 20. Plural contactors 11 constructed by an electrically conductive metal are implanted into the housing 10. The housing 10 has an opening portion 12 and is constructed by an insulating material. The metallic cover 20 is arranged so as to cover a portion of the housing 10 and is constructed by a steel plate, etc. The connector 1 also has the actuator 30 rotatably supported by the connector main body and constructed by an insulating material.

The opening portion 12 is opened and closed by rotating the actuator 30, and receives a flexible cable 2 such as FPC and FFC having an electrically conductive portion only on its lower face.

The flexible cable 2 is inserted into the opening portion 12 from the direction of the arrow X in the unlock state, and comes in press contact with the above contactor 11 by the actuator 30 in the rotation of the actuator 30. As its result, the cable 2 and the contactor 11 are electrically connected to each other in the lock state.

Figure 3:
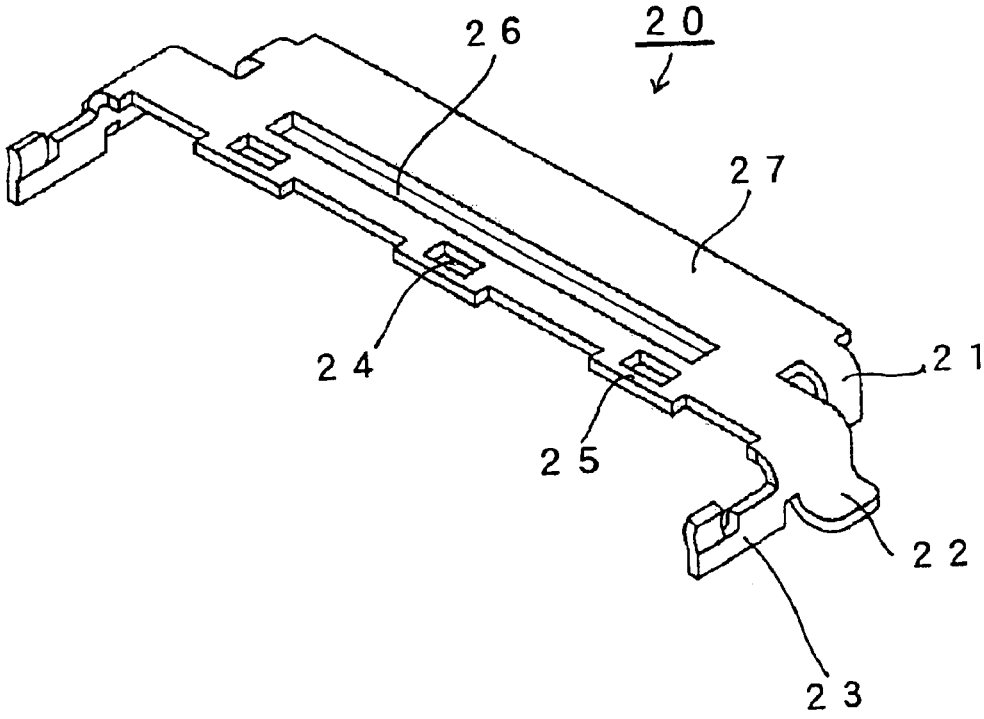
FIG. 3 is a perspective view of the external appearance of a metallic cover.
Figure 4:
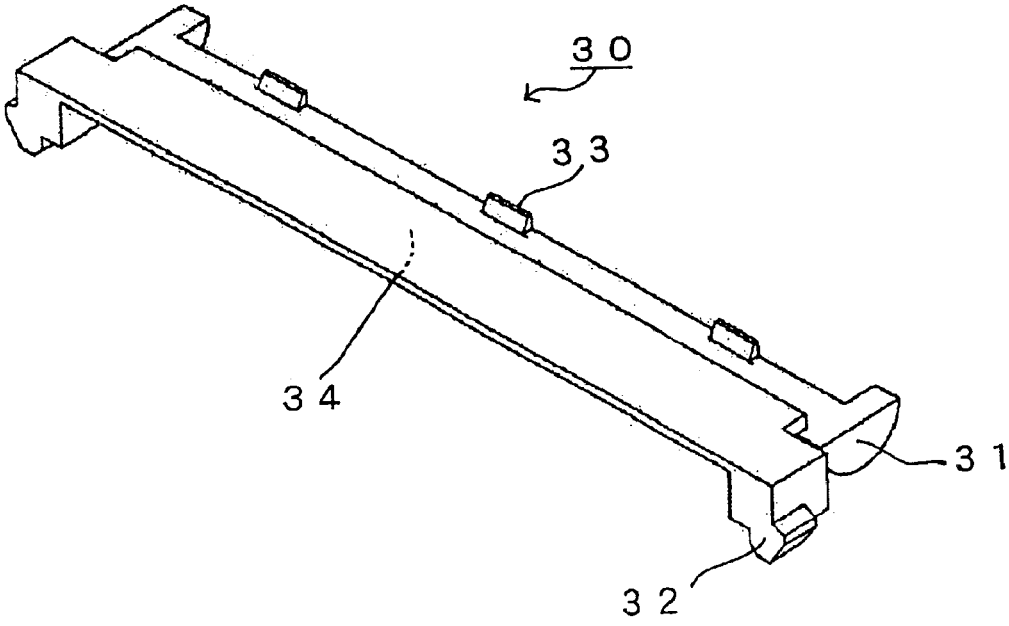
FIG. 4 is a perspective view of the external appearance of the actuator.

FIG. 3 is a perspective view of the external appearance of the metallic cover 20. FIG. 4 is a perspective view of the external appearance of the actuator 30.

The metallic cover 20 has an upper face portion 27, a reinforcing rib 26, a pair of holding portions 21 of a tongue piece shape, a pair of fixing portions 22 of a tongue piece shape, an engagement receiving portion 24, a receiving portion 25, a lock portion 23, etc. The upper face portion 27 covers a portion of the housing 10 except for a part in which the actuator 30 is located. The reinforcing rib 26 is moderately recessed from the upper face portion 27 and is extended in the longitudinal direction to raise rigidity of the cover 20. The holding portions 21 are arranged so as to hold the vicinity of an end portion of the housing 10 in its longitudinal direction and unite the cover 20 and the housing 10. The fixing portions 22 are extended out so as to cover both side end face portions of the housing 10, and are fixed to an unillustrated circuit substrate. The engagement receiving portion 24 receives an engaging portion 33 of the actuator 30 in the rotation of the actuator 30. The receiving portion 25 is located at the outer edge of the engagement receiving portion 24, and when the actuator 30 is engaged with this receiving portion 24 and the flexible cable 2 is pressed against the contactor 11 as the actuator 30 is rotated the receiving portion 25 receives reaction force from the contactor 11. The lock portion 23 fixes the actuator 30 in a lock position in cooperation with a locked portion 32 of the actuator 30.

On the other hand, the actuator 30 has the engaging portion 33, the locked portion 32, a rotation support portion 31, etc. The engaging portion 33 is formed in a projection shape and is engaged with the engagement receiving portion 24 in a position corresponding to the engagement receiving portion 24 of the metallic cover 20. The locked portion 32 is arranged so as to be locked together with the lock portion 23 in a position corresponding to the lock portion 23 of the metallic cover 20. Further, the rotation support portion 31 supports the rotation of the actuator 30 correspondingly to a rotation receiving portion 13 of the housing 10 in this rotation.

Figure 5:
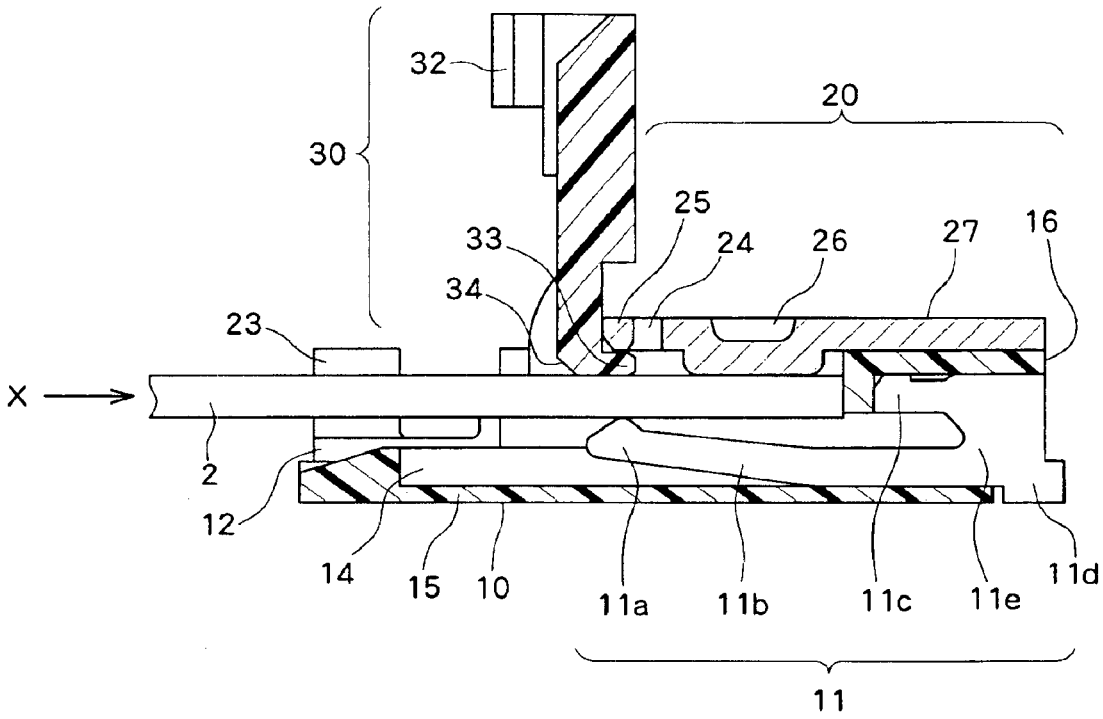
FIG. 5 is a cross-sectional view taken along line A–A' of FIG. 1 and shows the unlock state in which the actuator stands erect.
Figure 6:
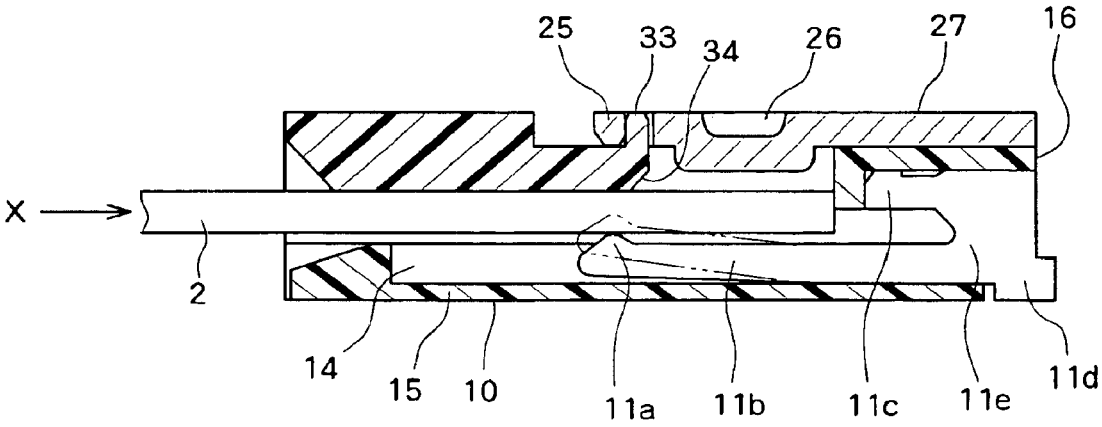
FIG. 6 is a cross-sectional view showing the lock state in which the actuator of the connector of FIG. 5 falls down.

Each of FIGS. 5 and 6 is a cross-sectional view taken along line A–A' of FIG. 1. FIG. 5 shows the unlock state and FIG. 6 shows the lock state.

The contactor 11 is implanted by press-fitting a base portion 11*e* into a contactor groove 14 formed in the housing 10. Further, the contactor 11 is electrically connected to an unillustrated circuit substrate by soldering a tail portion 11*d* to this circuit substrate.

A lower arm portion 11*b* of the contactor 11 is extended so as to be long in the inlet direction of the opening portion 12 from the base portion 11*e*. The lower arm portion 11*b* has a contact portion 11*a* near its tip to come in contact with an electrically conductive portion on the lower face of the flexible cable 2 inserted into the opening portion 12.

On the other hand, an upper arm portion 11*c* formed continuously to the lower arm portion 11*b* through the base portion 11*e* is shorter than the lower arm portion 11*b* and is merely slightly extended in the direction of the opening portion 12.

The metallic cover 20 covers the upper arm portion 11*c* of the contactor 11 and the vicinity of the upper face of a middle plate portion 16 of the housing 10 by the upper face portion 27 of the metallic cover 20. The metallic cover 20 is further extended from the upper face portion 27 toward the direction of the opening portion 12 until the vicinity located above the contact portion 11*a*. The engagement receiving portion 24 having an engagement through hole, and the receiving portion 25 adjacent to the engagement receiving portion 24 are formed near the tip of the metallic cover 20 extended in the direction of the opening portion 12.

As shown in FIG. 5, the flexible cable 2 is inserted into the housing 10 from the direction of the arrow X through the opening portion 12 in the unlock state, and is arranged between the contact portion 11*a* and the metallic cover 20.

At this time, in comparison with the thickness of the flexible cable 2, a sufficient clearance is prepared between the contact portion 11*a* and the metallic cover 20, or between the contact portion 11*a* and the actuator 30. Accordingly, the insertion resistance of the cable 2 is basically zero (ZIF).

After the flexible cable 2 is inserted into the opening portion 12, the tip of the actuator 30 is rotated around the receiving portion 25 in the rotation until the lock state as shown in FIG. 6, and the cable 2 is pressed against the contact portion 11*a* side by a pressing portion 34 of the actuator 30.

At this time, the thickness from the engaging portion 33 to the pressing portion 34 is adjusted such that the distance from the contact face of the actuator 30 and the flexible cable 2 to the rotation center of the receiving portion 25 is increased in the lock state in comparison with the unlock state. Therefore, as the actuator 30 is rotated, the pressing portion 34 presses downward the above flexible cable 2 and the contact portion 11*a* with the receiving portion 25 as the fulcrum of a lever, and flexes and deforms the lower arm portion 11*b* of the contactor 11. The pressing portion 34 is then forcibly slipped between the receiving portion 25 and the cable 2 by utilizing the downward displacement of the contact portion 11*a*.

In parallel with this slipping, the engaging portion 33 of the actuator 30 enters the engagement receiving portion 24 of the metallic cover 20 and prevents the actuator 30 from being separated from the connector main body.

In the lock state, the lock is completed between the lock portion 23 of the metallic cover 20 and the locked portion 32 of the actuator 30. The flexible cable 2 is nipped and supported by the reaction force of the contactor 11 between the actuator 30 and the contact portion 11*a* so that the cable 2 is completely connected to the connector 1.

Figure 7:
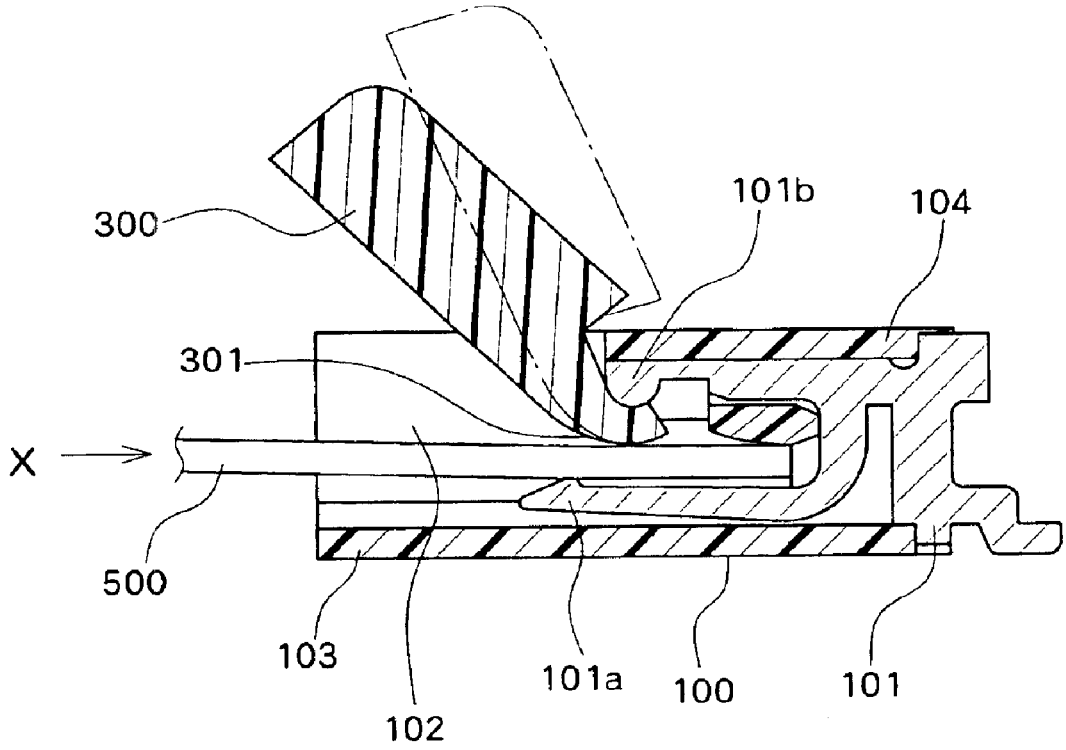
FIG. 7 is a cross-sectional view showing an example of a conventional connector.

As shown in FIGS. 5 and 6, the connector 1 of this embodiment mode has the metallic cover 20 having the receiving portion 25. Thus, the rotating support portion 101*b* shown in FIG. 7 in the above conventional connector is omitted and the number of members in the thickness direction of the connector is reduced to five members constructed by the bottom plate portion 15 of the housing 10, the contact portion 11*a*, the flexible cable 2, the pressing portion 34 and the receiving portion 25 so that the connector 1 can be correspondingly made thin.

Further, in the connector of this kind in which a portion of the actuator 30 is inserted between the flexible cable 2 and the receiving portion 25 as the actuator 30 is rotated, the receiving portion 25 for receiving the reaction force from the contactor 11 must resist a very large stress. Further, in the conventional connector, a member corresponding to the receiving portion 25 was formed by an insulating material such as synthetic resin, etc. having low rigidity, and a metal such as phosphor bronze, etc. Therefore, it was necessary to set the member corresponding to the receiving portion 25 to a considerable thickness so as to obtain a predetermined desirable rigidity. In contrast to this, the receiving portion 25 of the connector 1 in the present invention is constructed by a steel plate having high strength, etc., and a sufficient strength can be shown by a thickness thinner than that of the above conventional member. Therefore, the connector 1 can be made thin in comparison with the conventional case.

Further, the metallic cover 20 approximately covers the half of the housing 10 and is arranged so as to hold the housing 10, and is fixed to the circuit substrate by the fixing portion 22. Accordingly, the strength conventionally imposed on the housing can be also obtained by this metallic cover 20 so that the connector can be made thinner.

Further, the rigidity of the metallic cover 20 can be improved and its thickness can be reduced by arranging the reinforcing rib 26 in the metallic cover 20.

In particular, when the engagement receiving portion 24 has an engagement through hole extending through the metallic cover 20 and the receiving portion 25 is formed correspondingly to the engagement receiving portion 24 as in this embodiment, the engagement of the engaging portion 33 and the engagement receiving portion 24 can be completed in the range of the thickness of one sheet of the metallic cover 20 so that a much thinner connector can be provided.

Further, since the lock portion 23 is constructed as part of the metallic cover 20, the lock portion 23 can be simply formed simultaneously at a press forming time of the cover 20. Further, when the lock portion 23 and the locked portion 32 are locked to prevent the actuator from opening, a click feeling can be obtained.

Further, since the housing 10 is covered with the metallic cover 20, a shield effect can be also obtained.

In accordance with the present invention, a thin type connector of 1.5 mm or less in thickness can be obtained by the characteristics explained above.

As described below in detail, the mode of each portion constituting the connector in the present invention is not limited to this embodiment.

Three engagement receiving portions 24 of the metallic cover 20 shown in FIG. 3 are arranged at an equal interval in positions moderately separated in the longitudinal direction as long rectangular through holes in the longitudinal direction. However, the engagement receiving portion 24 is not limited to have the through hole, but may be also formed as a hollow having a moderate depth. Further, the number of the engagement receiving portion 24 may be one or more.

As shown in FIG. 3, the receiving portion 25 of the metallic cover 20 is formed like a frame projected forward along the shape of the engagement receiving portion 24. However, the receiving portion 25 may not be formed in the projecting shape if the receiving portion 25 has a strength resisting the reaction force of the contactor 11.

As shown in FIG. 3, the fixing portion 22 of the metallic cover 20 is bent toward the unillustrated circuit substrate while forming a smooth curved surface near the side end portion of the housing 10. However, this construction is used to fix the connector 1 to the circuit substrate. Accordingly, the fixing portion 22 may thrust through the circuit substrate and bent on the rear face of the substrate to be fixed thereto, may be soldered on this rear face, or may be also fixed by using a screw, etc. Otherwise, the fixing portion 22 may be also formed in a shape in which the fixing portion 22 draws a curved surface and is not extended out.

Further, in this embodiment mode, the metallic cover 20 has the engagement through hole of the engagement receiving portion 24 and the receiving portion 25, and the actuator 30 has the engaging portion 33 of a projecting shape as an example. However, the present invention is not limited to this example. For example, as the connector shown by JP-A-2000-106238, the following structure may be also used. Namely, a through hole and an engaging portion 33 having the function of a cam portion are arranged in the actuator 30. In the rotation of the actuator 30, the engaging portion 33 presses the flexible cable 2 against the contact portion 11*a*, and its reaction force is received by the above receiving portion 25 of the metallic cover 20. Further, the tip portion of the receiving portion 25 can be made so as to be inserted into/pulled out of the through hole. In this embodiment mode, the receiving portion 25 and the engagement receiving portion 24 become the same member.

As explained above, the connector 1 in the present invention can be made thin by arranging the metallic cover 20 covering a portion of the housing 10 and having the holding portion 21 for holding the housing 10, the fixing portion 22 to be fixed to the circuit substrate, and the receiving portion 25 for receiving the reaction force of the press contact of the flexible cable 2 and the contactor 11 in the rotation of the actuator 30.

What is claimed is:

1. A connector comprising a connector main body comprising a housing for storing plural contactors and comprising an opening portion and constructed by an insulating material, and an actuator rotatably supported with respect to said connector main body and constructed by an insulating material, wherein a flexible cable inserted into said opening portion and said contactors come in press contact with each other by the actuator and are electrically connected to each other in the rotation of said actuator, said connector main body has a metallic cover for covering a portion of said housing and said metallic cover comprising a holding portion for holding the housing, a fixing portion to be fixed to a circuit substrate and one or more engagement receiving portions, said actuator includes one or more engaging portions engaged with said engagement receiving portions during rotation, and said metallic cover includes a receiving portion for receiving reaction force of the press contact when said actuator makes said flexible cable come in press contact with said contactors.

2. The connector according to claim 1, wherein said metallic cover includes a lock portion, and said actuator includes a locked portion corresponding to said lock portion.

3. The connector according to claim 1, wherein said engagement receiving portion includes an engagement through hole extending through said metallic cover to receive said engaging portion in the rotation of said actuator.

4. The connector according to claim 3, wherein said metallic cover includes a lock portion, and said actuator includes a locked portion corresponding to said lock portion.

* * * * *